US006053343A

United States Patent [19]

Krueger

[11] Patent Number: 6,053,343

[45] Date of Patent: Apr. 25, 2000

[54] CHILD-RESISTANT CLOSURE AND CONTAINER WITH TAMPER INDICATION

[75] Inventor: David F. Krueger, Lancaster, Pa.

[73] Assignee: Kerr Group, Inc., Lancaster, Pa.

[21] Appl. No.: 09/078,643

[22] Filed: May 14, 1998

[51] Int. Cl.[7] ..... B65D 50/08; B65D 41/34

[52] U.S. Cl. ..... 215/209; 215/221; 215/252

[58] Field of Search ..... 215/250, 252, 215/258, 209, 217–219, 221, 330, 349, 303, 305

[56] References Cited

U.S. PATENT DOCUMENTS

| | | | |
|---|---|---|---|
| 3,417,893 | 12/1968 | Lieberman . | |
| 3,730,370 | 5/1973 | Lecinski . | |
| 3,773,203 | 11/1973 | Grimaldi et al. . | |
| 3,844,438 | 10/1974 | St. Pierre et al. . | |
| 3,857,508 | 12/1974 | LaBarge et al. . | |
| 3,884,379 | 5/1975 | Landen . | |
| 3,891,110 | 6/1975 | Gach . | |
| 3,895,730 | 7/1975 | Koehne et al. . | |
| 4,036,385 | 7/1977 | Morris | 215/209 |
| 4,210,251 | 7/1980 | Grussen . | |
| 4,213,534 | 7/1980 | Montgomery . | |
| 4,336,890 | 6/1982 | Möhlmann . | |
| 4,345,690 | 8/1982 | Hopley . | |
| 4,375,858 | 3/1983 | Shah et al. . | |
| 4,383,618 | 5/1983 | Dougherty . | |
| 4,436,211 | 3/1984 | Gach . | |
| 4,588,097 | 5/1986 | Hauser . | |
| 4,752,014 | 6/1988 | House et al. . | |
| 5,058,754 | 10/1991 | Hickerson | 215/219 X |
| 5,165,559 | 11/1992 | Kusz . | |
| 5,271,512 | 12/1993 | Ekkert | 215/330 X |
| 5,394,999 | 3/1995 | Krall . | |
| 5,413,233 | 5/1995 | Hall | 215/330 X |
| 5,511,677 | 4/1996 | Oder | 215/252 |
| 5,586,671 | 12/1996 | Thomas et al. . | |
| 5,588,545 | 12/1996 | King . | |
| 5,706,962 | 1/1998 | Tauber | 215/218 |
| 5,735,417 | 4/1998 | Darr et al. | 215/330 X |
| 5,788,098 | 8/1998 | Mader | 215/330 X |
| 5,816,422 | 10/1998 | Roig | 215/250 X |
| 5,836,465 | 11/1998 | King | 215/252 X |

*Primary Examiner*—Nathan J. Newhouse
*Attorney, Agent, or Firm*—Kenyon & Kenyon

[57] ABSTRACT

A child-resistant, tamper indicating closure according to the present invention includes a closure top having an outer edge. An annular skirt depends from the outer edge of the closure top, the skirt having a plurality of internal splines located on an inner surface. A tamper indicating band is connected to the skirt, for example, along a frangible line, the tamper indicating band having a plurality of external splines located on an outer surface. The internal and external splines may cooperate with a locking mechanism disposed on the container so that when a tab of the locking mechanism is not depressed, an inner locking member contacts an internal spline to lock the closure in place. When the tab is depressed, the inner locking members are free to rotate, but outer locking member contacts an external spline, so that if the closure is rotated, for example, in the counter-clockwise direction, the tamper indicating band separates from the skirt along a frangible line.

17 Claims, 4 Drawing Sheets

CHILD-RESISTANT CLOSURE AND CONTAINER WITH TAMPER INDICATION

FIELD OF THE INVENTION

The present invention relates to closures for containers, and in particular closures that include child-resistant and tamper indicating elements.

BACKGROUND INFORMATION

Many closures or containers are provided with some type of child-resistant mechanism to prevent removal of the closure absent some manipulation of the closure or container beyond the normal rotational motion. For example, many closures include inner and outer parts that cooperate to allow closure of the container via simple rotation, but require axial depression of the closure to effect counter-rotation and removal of the closure. Other closures or containers include mechanisms that require radial depression of part of the closure for removal. Often these known mechanisms suffer from several drawbacks. While making the closure difficult for a child to remove, many child-resistant mechanisms also create difficulties for adults, in particular the elderly or those suffering from arthritis or similar debilitating conditions. In addition, some child-proof mechanisms have a tendency to fail after repeated use. In many cases, efforts to overcome these difficulties result in closures or containers which are relatively complicated and expensive to manufacture.

Similarly, closures or containers often include tamper-indicating mechanisms. In some cases, tamper-indication is provided by a band disposed on the bottom edge of a closure. Attempted removal or tampering of the closure causes the band to separate from the closure skirt, providing an indication of the tampering. The band may include a number of upwardly and inwardly extending tabs that abut against a shoulder on the neck of the container. When the closure is removed, the tabs contact the shoulder to retain the band on the container. The band generally separates from the skirt along some sort of frangible line.

In some cases, closures or containers include both child-resistant and tamper indicating mechanisms. For example, U.S. Pat. No. 4,752,014 to House et al. describes a closure including a push tab disposed on the skirt. In order to rotate the closure to remove the closure, the push tab must be depressed radially inwardly. At the same time, depression of the push tab causes a pair of fragile webs to break, thereby providing tamper indication. In this case, the lack of a tamper-indicating band may cause some consumers to assume that tamper indication is not present. In addition, even if the tamper-indicating function of the webs is deduced by the consumer, the small size of the webs makes it difficult at first glance to determine whether tampering has occurred. Other combined child-resistant and tamper indicating closures or containers suffer similar problems or problems discussed above. In addition, in many cases known child-resistant mechanisms and tamper indicating mechanism are not complimentary, requiring complicated designs to incorporate the two features that increase manufacturing costs and risk of failure.

SUMMARY OF THE INVENTION

A child-resistant, tamper indicating closure according to the present invention includes, for example, a closure top and an annular skirt depending, for example, from the closure top, the skirt having a plurality of internal splines located on an inner surface. A tamper indicating band is connected to the skirt, for example, along a frangible line, the tamper indicating band having a plurality of external splines located on an outer surface. The internal and external splines may cooperate, for example, with a locking mechanism disposed on the container so that when a tab of the locking mechanism is not depressed, an inner locking member contacts an internal spline to lock the closure in place. When the tab is depressed, the inner locking members are free to rotate, for example, but an outer locking member contacts an external spline, so that if the closure is rotated, for example, in the counter-clockwise direction, the tamper indicating band separates from the skirt along a frangible line.

DETAILED DESCRIPTION OF THE INVENTION

FIGS. 1 to 4 illustrate an exemplary container 10 and closure 30 according to the present invention. Container 10 includes, for example, a neck 12 having an external thread 14 which extends to an opening. Container 10 may include formations other than or in addition to external thread 14 to retain the closure 30 on the container 10.

Figure 1:
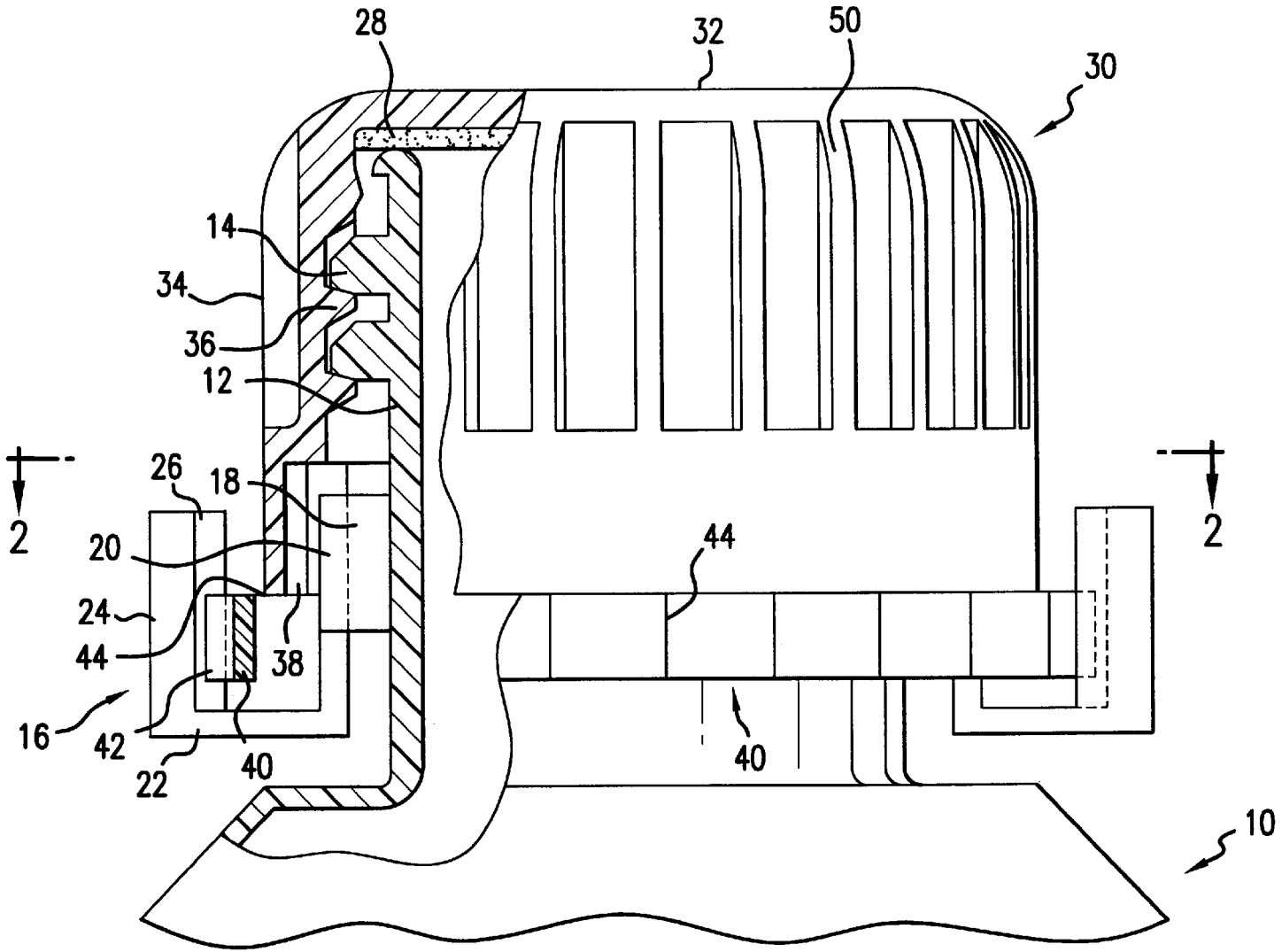
FIG. 1 is a partially open view of an exemplary embodiment of a closure and a container according to the present invention.
Figure 2:
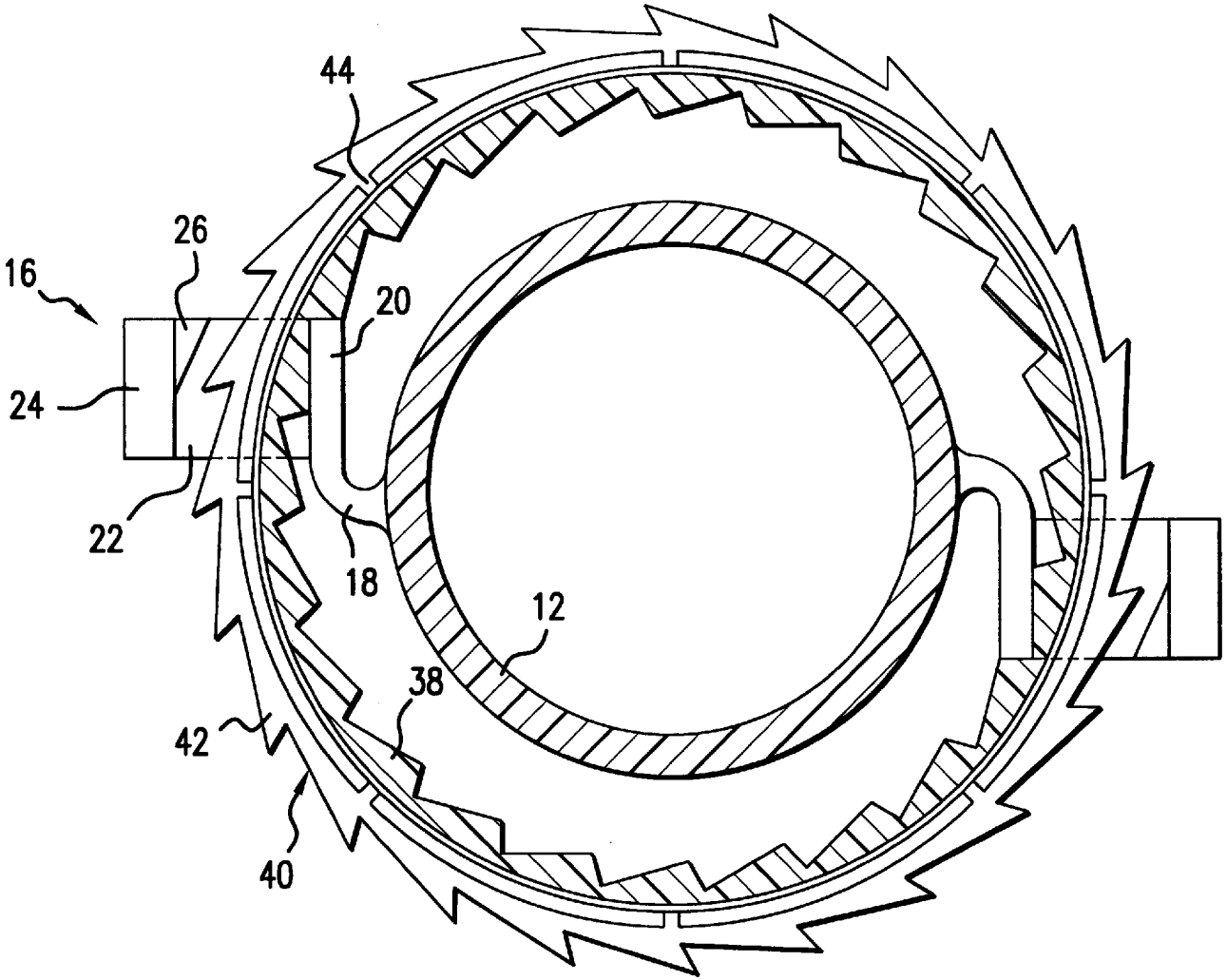
FIG. 2 is a cross-sectional view of the closure and container of FIG. 1 taken along the line 2—2.
Figure 3:
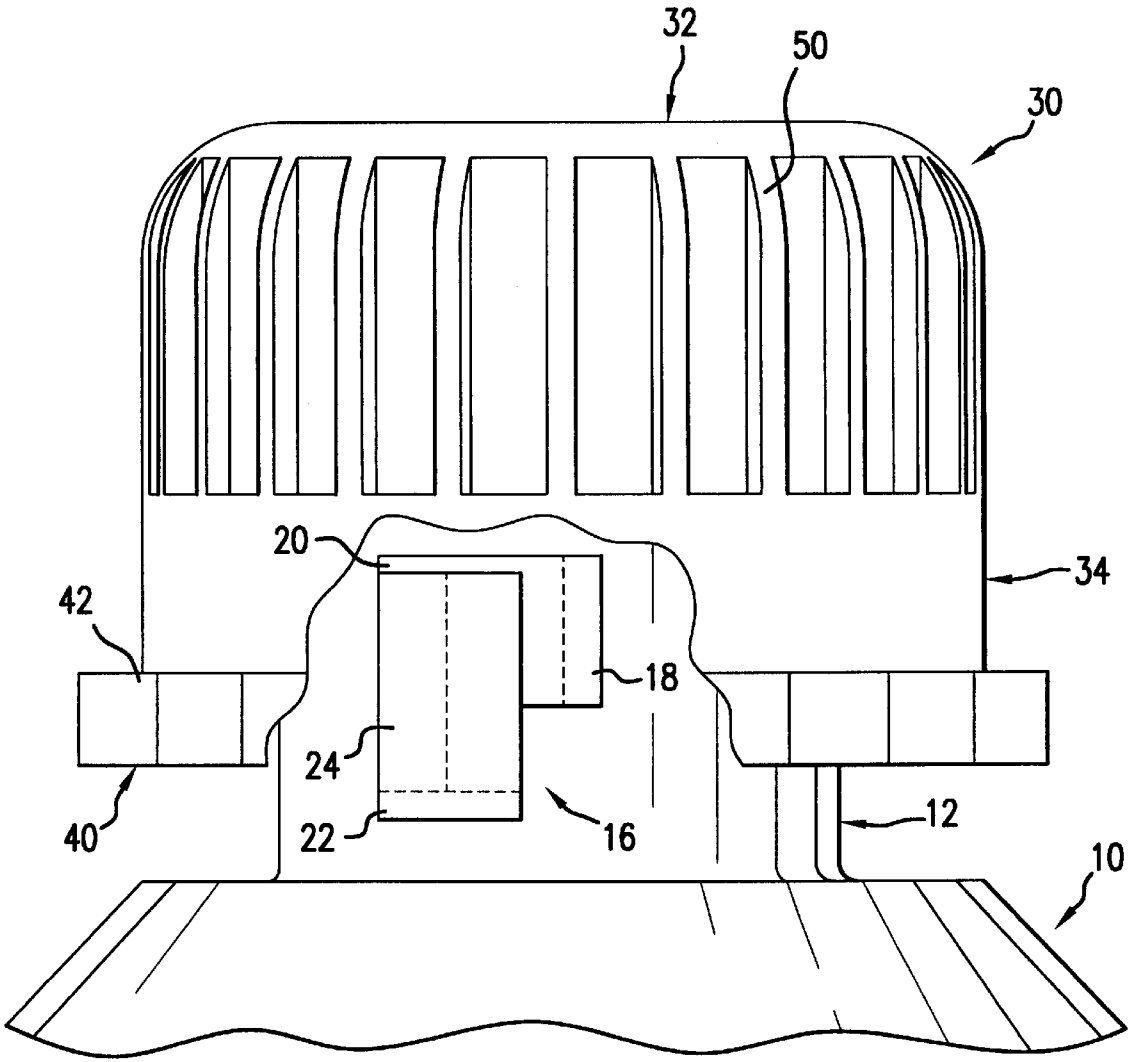
FIG. 3 is another partially open view of the closure and container of FIG. 1.
Figure 4:
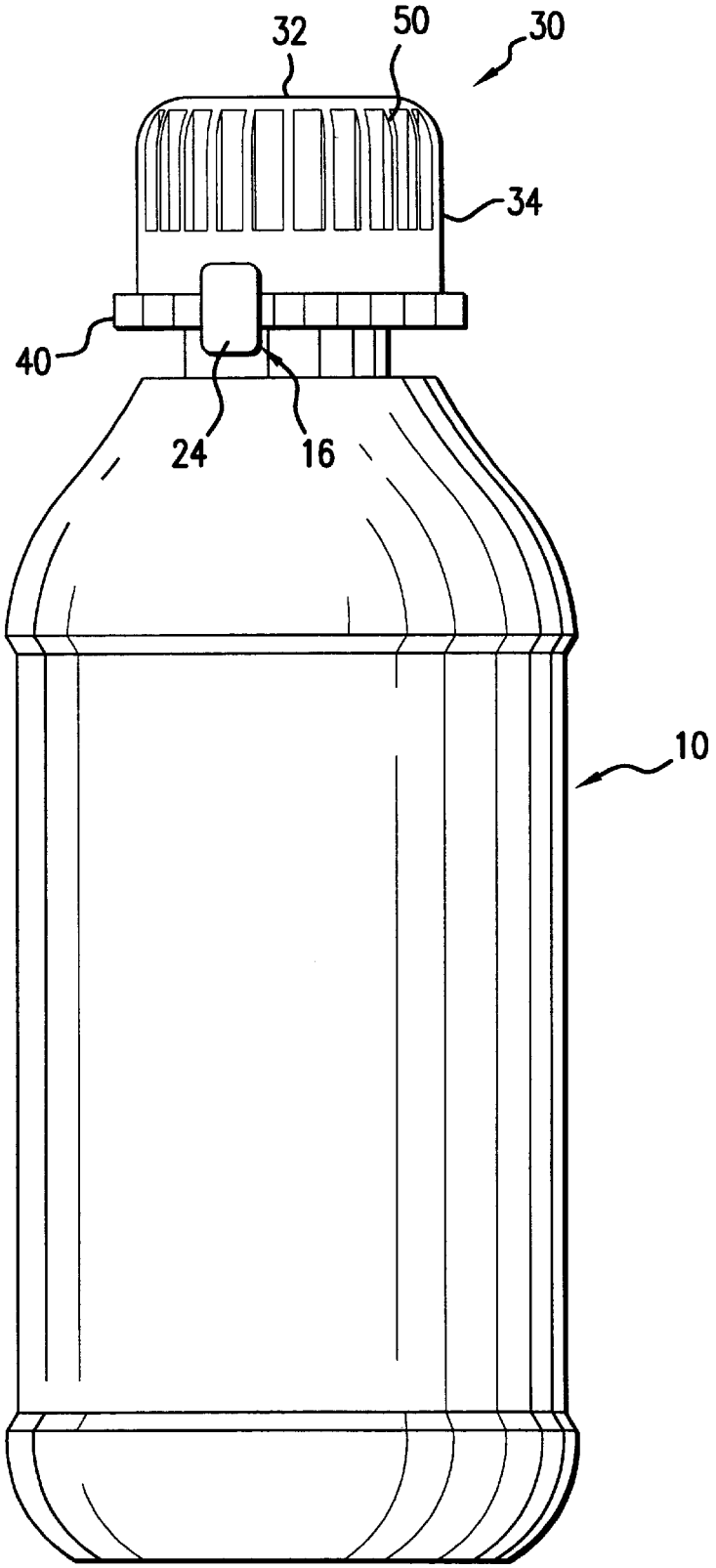
FIG. 4 is a side view of a closure and container according to the present invention.

A pair of locking mechanisms 16 are disposed, for example, on opposites sides of the neck 12 and below the external thread 14, although greater or fewer locking mechanisms may be provided. Locking mechanism 16 includes, for example, a flexible hinge 18 connected to neck 12. On its opposite end, hinge 18 is joined, for example, to inner locking member 20. In the exemplary embodiment of FIGS. 1 to 4, inner locking member 20 is, in cross-section, a linear extension of hinge 18, but extends further downwardly than hinge 18, as shown in FIG. 1. Radial extension 22 is connected, for example, to inner locking member 20, preferably at the lower end of inner locking member 20. Radial extension 22 extends substantially radially outwardly, for example, from inner locking member 20, and is connected at its outer end to tab 24. Locking mechanism 16 also includes, for example, an outer locking member 26. In the exemplary embodiment, outer locking member 26 is formed as a triangular tooth located on the inner surface of tab 24, as illustrated in FIG. 2.

As can be seen in FIG. 1, tab 24 (along with outer locking member 26), radial extension 22, and inner locking member 20 together have, for example, a roughly U-shaped cross-section when viewed from the side. Tab 24 and inner locking member 20 form the upward arms of the U-shape, while radial extension 22 forms the base of the U-shape. Preferably, the arrangement is designed so that when tab 24 is depressed (towards the neck 12), hinge 18 flexes so that both locking members 20 and 26 deflect radially inwardly from an outer position to an inner position. It should be understood that many configurations of the locking mechanism 16 will achieve the result of having both the inner and outer locking members 20 and 26 deflect inwardly when the tab 24 is depressed.

Closure 30 is arranged to engage at least part of neck 12. Closure 30 includes, for example, a substantially circular closure top 32 covering the opening of the container 10. An annular skirt 34 depends, for example, from the outer edge of the closure top 32, extending, for example, into the U-shaped cross-section of the locking mechanism 16. Skirt 34 preferably includes an internal thread 36 that cooperates with external thread 14 to retain the closure 30 on the container 10. As with the external thread 14, the internal thread 36 may be replaced with or assisted by any suitable alternative formation to retain the closure 30. In the illustrated embodiment, closure 30 also includes, for example, a sealing surface 28, or liner, located on the inner surface of closure top 32. Sealing surface 28 is preferably compressed when closure 30 is placed on container 10, thereby sealing container 10. The illustrated closure 30 also includes, for example, a plurality of longitudinal ridges 50 on the outer surface of closure 30. Ridges 50 provide an effective gripping surface for the consumer, allowing easier rotation of the closure 30 with respect to the container 10.

Disposed on the internal surface of the skirt 34, for example below the internal thread 36, are a plurality of internal splines 38. In the embodiment of FIGS. 1 to 4, for example, the skirt 34 includes a continuous series of internal splines 38 disposed circumferentially about the skirt 34. Fewer splines may, of course, be employed, but a minimum of two splines is preferable. As illustrated in FIG. 2, the internal splines 38 contact the inner locking member 20 when the inner locking member 20 is in an unbiased, outer position. The shape of the internal splines 38 allows the closure 30 to rotate clockwise around the container 10, as when the closure is applied to the container, but prevents counterclockwise rotation of the closure 30 (as viewed in FIG. 2), thereby locking the closure 30 onto the container 10. Accordingly, the closure 10 cannot be removed from the container 10 without depressing the tab 24. Once tab 24 is depressed, however, inner locking member 20 deflects inwardly to its inner position, allowing internal splines 38 to pass freely and allowing the closure 30 to rotate (not including the tamper indicating ring 40, discussed below). It should be understood that if fewer splines are employed than in the exemplary embodiment, the inner locking member 20 may not actually contact an internal spline 38. Instead, the closure 30 may be in a position in which it must be rotated counter-clockwise in order for the inner locking member 20 to actually abut an internal spline 38. For purposes of clarity, however, the term "contact" as used herein should be read to include such a position or arrangement in which the closure 30 must be rotated in order for the inner locking member to actually abut against an internal spline 38.

Closure 10 may also include an annular tamper indicating band 40 depending, for example, from the bottom of skirt 34. Tamper indicating band 40 is connected to the skirt 34, for example along frangible line 44. Frangible line 44 may be any type of frangible connection, but in the exemplary embodiment of the Figures frangible line 44 is formed by a series of circumferentially-spaced bridges. Similarly, frangible line 44 may be formed by any suitable manufacturing process, as discussed below.

Tamper indicating band 40 includes, for example, a plurality of external splines 42. In the exemplary embodiment illustrated in FIGS. 1 and 2, tamper indicating band 40 includes a continuous series of external splines 42 disposed circumferentially around tamper indicating band 40. As with internal splines 38, however, there may be fewer external splines 42 than are shown in FIGS. 1 and 2, but preferably at least two external splines 42 are present. Tamper indicating band 40 is arranged, for example, so that the external splines 42 contact the outer locking member 26 when the tab 24 is depressed. When tab 24 is not depressed, external splines 42 and the remainder of the tamper indicating band 40 are free to rotate in either direction within, for example, the U-shaped cross-section of the locking mechanism 16. With tab 24 depressed, however, the tamper indicating band 40 may only rotate, for example, in the clockwise direction. Accordingly, the closure 30 may be screwed onto the container 10 without interference by the external splines 42. However, when the tab 24 is depressed, allowing the closure top 22 and skirt 24 to be removed from the container 10, inner locking member 26 engages the internal splines 42, preventing counter-clockwise rotation of the tamper indicating band 40 and causing the tamper indicating band 40 to separate from the skirt 24 along frangible line 44. Thus an attempt to remove the closure 30 from the container 10 will result in damage along the frangible line 44 and separation of the tamper indicating band 40 from the skirt 24.

In manufacture, the closure 30 may be produced in any suitable manner. For example, the various elements described above may be formed separately or in groups and later joined together. In the embodiment of FIGS. 1 to 4, the entire closure 30, including tamper indicating band 40, is formed as an integral unit, for example by injection molding or compression molding. The frangible line 44 may also be formed in any suitable manner. If the closure 30 is formed integrally, for example, the frangible line may be molded as part of the originally-molded structure, or may later be scored into the closure 30. Similarly, the container 10 may also be formed as several separate elements or as a single, integrally molded unit, including locking mechanism 16. Like the closure 30, the exemplary container, including locking mechanism 16, is formed as an integral unit, for example by injection or compression molding.

The device according to the present invention has been described with respect to several exemplary embodiments. It can be understood, however, that there are many other variations of the above-described embodiments which will be apparent to those skilled in the art, even where elements have not explicitly been designated as exemplary. For example, many types of sealing arrangements may be employed in conjunction with or as alternatives to sealing surface 28. Similarly, frangible line 44 may be formed, for example, as a solid line of relatively thin cross section rather than as a series of bridges. Other modifications to these and other elements are also possible. It is understood that these modifications are within the teaching of the present invention, which is to be limited only by the claims appended hereto.

What is claimed is:

1. A child-resistant, tamper indicating closure for a container, comprising:

a closure top;

an annular skirt depending from the closure top, the skirt having a plurality of internal splines located on an inner surface; and an annular tamper indicating band connected to the skirt along a frangible line, the tamper indicating band having a plurality of external splines located on an outer surface, the each of the external splines including a locking surface and a ramped surface, each ramped surface inclined in a direction defined by the circumference of the closure.

2. The closure according to claim 1, wherein the closure includes a continuous series of the internal splines disposed around a circumference of the skirt.

3. The closure according to claim 1, wherein the closure includes a continuous series of the external splines disposed around a circumference of the tamper indicating band.

4. The closure according to claim 3, wherein the closure includes a continuous series of the internal splines disposed around a circumference of the skirt.

5. The closure according to claim 1, wherein the closure top, the skirt, and the tamper indicating band are formed integrally.

6. The closure according to claim 5, wherein the closure top, the skirt, and the tamper indicating band are formed by injection molding.

7. The closure according to claim 5, wherein the closure top, the skirt, and the tamper indicating band are formed by compression molding.

8. A child-resistant, tamper indicating closure and container, comprising:

a container having a neck, the neck including:

an external thread disposed on an outer surface of the neck;

a locking mechanism disposed on the outer surface of the neck, the locking mechanism including:

a flexible hinge connected to the outer surface of the neck below the external thread;

an inner locking member connected to the flexible hinge;

a radial extension connected to the inner locking member, the radial extension extending substantially radially outward from the inner locking member;

a tab connected to an outer end of the radial extension; and an outer locking member associated with the tab; and a closure, including:

a closure top having an outer edge;

an annular skirt depending from the outer edge of the closure top, the skirt having a plurality of internal splines located on an inner surface, at least one internal spline in contact with the inner locking member to prevent removal of the closure from the container, and the skirt having an internal thread disposed on the inner surface, the internal thread cooperating with the external thread so that when the closure is rotated in a clockwise direction the closure is retained on the container and when the closure is rotated in a counter-clockwise direction the closure is removed from the container; and a tamper indicating band connected to the skirt along a frangible line, the tamper indicating band having a plurality of external splines located on an outer surface;

wherein when the tab is depressed inwardly, the hinge flexes so that inner and outer locking members deflect from an outer position to an inner position, such that the outer locking member contacts at least one external spline so that when the closure is removed from the container, the tamper indicating band separates from the skirt along the frangible line.

9. The closure according to claim 8, wherein the closure includes a continuous series of the internal splines disposed around a circumference of the skirt.

10. The closure according to claim 8, wherein the closure includes a continuous series of the external splines disposed around a circumference of the tamper indicating band.

11. The closure according to claim 10, wherein the closure includes a continuous series of the internal splines disposed around a circumference of the skirt.

12. The closure according to claim 8, wherein the closure top, the skirt, and the tamper indicating band are formed as a first integral unit, and wherein the container is formed as a second integral unit.

13. The closure according to claim 12, wherein the first and second integral units are formed by injection molding.

14. The closure according to claim 12, wherein the first and second integral units are formed by compression molding.

15. The closure according to claim 8, wherein the inner locking member, the radial extension, and the outer locking member together have a substantially U-shaped cross-section.

16. The closure according to claim 8, wherein the closure further includes a sealing surface disposed on an inner surface of the closure top, the sealing surface being compressed when the closure is placed on the container to seal the container.

17. The closure according to claim 8, wherein the frangible line includes a plurality of bridges connecting the skirt to the tamper indicating band.

* * * * *